US006536979B1

(12) United States Patent
Kenny et al.

(10) Patent No.: US 6,536,979 B1
(45) Date of Patent: Mar. 25, 2003

(54) SAFE WATER TOOTHBRUSH ASSEMBLY

(76) Inventors: Thomas A. Kenny, 5692 Clearview Dr., Troy, MI (US) 48098; Robert Gillings, 1470 Riversedge, Caro, MI (US) 48723

( * ) Notice: Subject to any disclaimer, the term of this patent is extended or adjusted under 35 U.S.C. 154(b) by 0 days.

(21) Appl. No.: 09/995,934

(22) Filed: Nov. 28, 2001

(51) Int. Cl.[7] ..... A46B 11/04

(52) U.S. Cl. ..... 401/270; 401/271; 401/278; 401/183; 401/186

(58) Field of Search ..... 401/270, 271, 401/277, 278, 183, 184, 186, 169, 156

(56) References Cited

U.S. PATENT DOCUMENTS

| | | | | | |
|---|---|---|---|---|---|
| 919,440 | A | * | 4/1909 | Smith et al. | 401/269 |
| 1,563,190 | A | * | 11/1925 | House | 401/286 |
| 1,859,402 | A | * | 5/1932 | Maher | 401/152 |
| 2,305,158 | A | * | 12/1942 | Hanses | 222/260 |
| 2,306,482 | A | | 12/1942 | Livingston | 15/138 |
| 3,234,953 | A | * | 2/1966 | Moynihan | 401/183 |
| 3,256,894 | A | * | 6/1966 | Sherman | 401/176 |
| 3,501,243 | A | * | 3/1970 | Heiskell et al. | 401/131 |
| 3,653,778 | A | * | 4/1972 | Freiling | 401/183 |
| 3,738,762 | A | * | 6/1973 | Moore et al. | 401/186 |
| 3,864,047 | A | * | 2/1975 | Sherrod | 401/278 |
| 4,199,270 | A | * | 4/1980 | Tomasini | 401/183 |
| 4,221,492 | A | * | 9/1980 | Boscardin et al. | 401/184 |
| 4,384,645 | A | * | 5/1983 | Manfredi | 206/229 |
| 4,580,588 | A | * | 4/1986 | Swope, Jr. | 132/311 |
| 5,123,765 | A | * | 6/1992 | O'Connell et al. | 401/126 |
| 5,350,248 | A | * | 9/1994 | Chen | 401/195 |
| 5,361,446 | A | | 11/1994 | Rufo | 15/167.1 |
| 5,481,775 | A | | 1/1996 | Gentile et al. | 15/22.1 |
| 5,503,553 | A | | 4/1996 | Hines | 433/80 |
| 5,507,641 | A | | 4/1996 | Cline | 433/1 |
| 5,517,712 | A | | 5/1996 | Schiano | 15/167.1 |
| 5,518,300 | A | | 5/1996 | Meyer | 300/21 |
| 5,533,227 | A | | 7/1996 | Ito et al. | 15/167.1 |
| 5,640,735 | A | | 6/1997 | Manning | 15/29 |
| 5,667,483 | A | | 9/1997 | Santos | 601/162 |
| 5,683,192 | A | | 11/1997 | Kilfoil | 401/289 |
| 5,720,048 | A | | 2/1998 | Perez | 2/161.6 |
| 5,893,378 | A | | 4/1999 | Llerena | 132/311 |
| 5,908,257 | A | * | 6/1999 | Martin | 401/271 |
| 5,918,995 | A | | 7/1999 | Puurunen | 401/146 |
| 5,966,769 | A | | 10/1999 | Tortorice | 15/105 |
| 6,000,410 | A | | 12/1999 | Tortorice | 132/308 |
| 6,047,429 | A | | 4/2000 | Wu | 15/29 |
| 6,056,466 | A | | 5/2000 | Johnson et al. | 401/188 R |
| 6,088,869 | A | | 7/2000 | Kaneda et al. | 15/167.1 |
| 6,164,967 | A | | 12/2000 | Sale et al. | 433/80 |
| 6,217,327 | B1 | | 4/2001 | Bedi | 433/80 |

* cited by examiner

*Primary Examiner*—Timothy L. Maust
*Assistant Examiner*—Huyen Le
(74) *Attorney, Agent, or Firm*—Gifford, Krass, Groh, Sprinkle, Anderson & Citkowski, P.C.

(57) ABSTRACT

A safe water toothbrush assembly for brushing teeth includes a toothbrush connected to a bottle. The toothbrush has an elongated body with a head at one end and an opposite end that is open, such that the interior of the body forms a passageway for transporting a fluid through the body, the head includes at least one aperture and the open end of the body is threaded. The toothbrush also includes a plurality of bristles extending radially from the head. The bottle is filled with a fluid, and an open end of the bottle includes threads complementary to the threads on the open end of the toothbrush, for securing the bottle to the toothbrush.

15 Claims, 2 Drawing Sheets

FIG. 5.
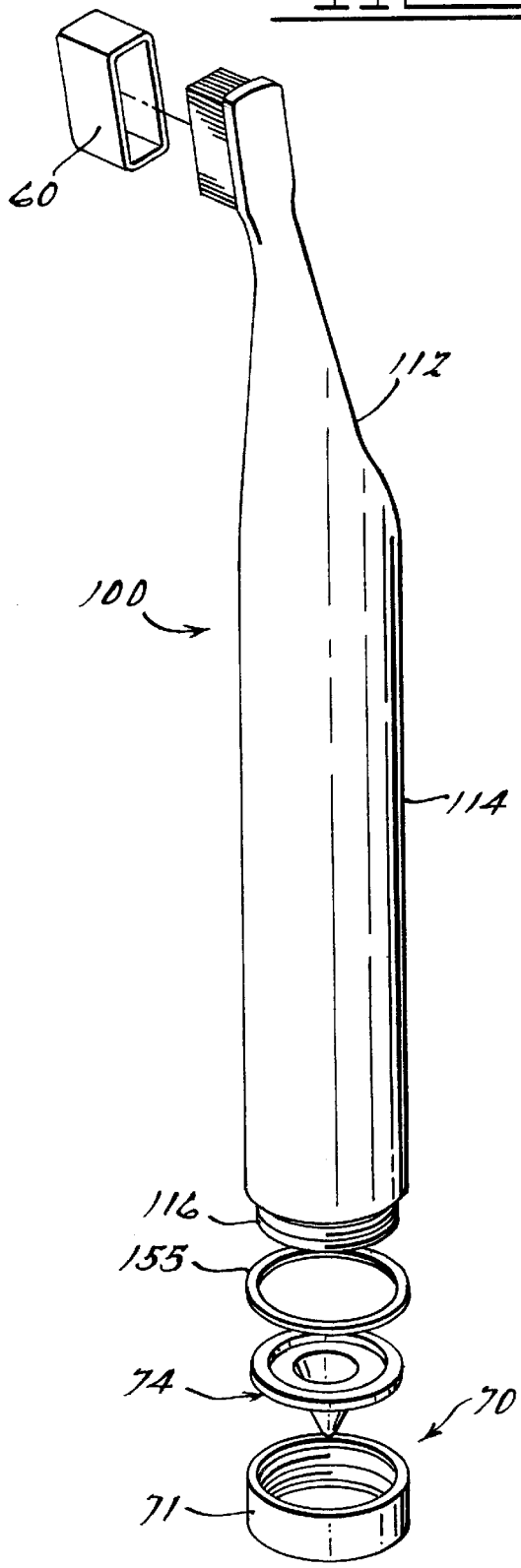
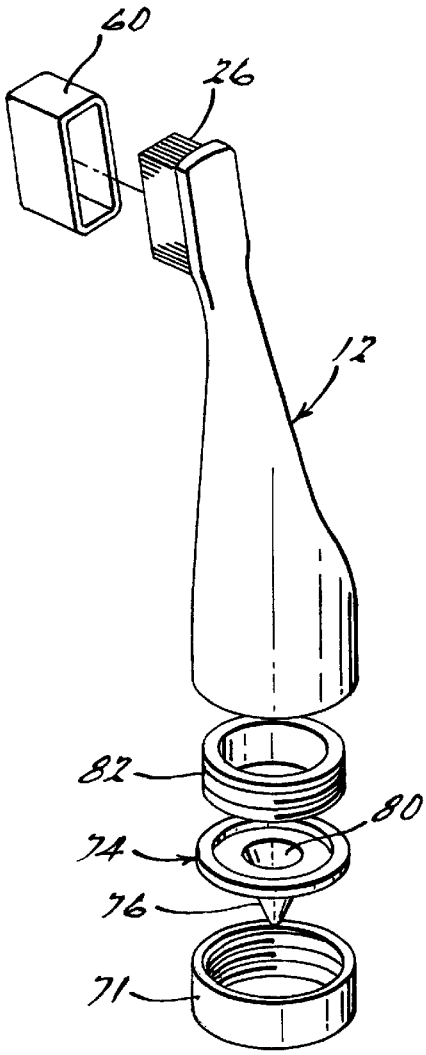
FIG. 6.

SAFE WATER TOOTHBRUSH ASSEMBLY

BACKGROUND OF THE INVENTION

1. Field of the Invention

The present invention relates generally to a toothbrush and, more specifically, to a toothbrush integral with a safe water supply.

2. Description of the Related Art

Oral hygiene is an important aspect of an individual's health. However, there are times when oral hygiene, and in particular tooth brushing, is compromised due to the unavailability of a water supply. For example, when traveling in certain areas of the world, the quality of the water supply may be in question, and bottled water is recommended for drinking and other such purposes. It is difficult to manage a toothbrush in one hand and coordinate a stream of water from bottled water in the other. In a health care environment, such as a hospital or nursing home, a fresh water supply may not be readily available or the individual is bedridden, thus making it difficult for the individual to maintain good oral hygiene by brushing their teeth.

Various types of portable or travel toothbrushes are disclosed in the art. For example, U.S. Pat. No. 5,683,192 to Kilfoil discloses a toothbrush with an internal water delivery system that receives its water supply from a shower. In this example, the toothbrush is connected to a hose that is operatively connected to a shower head. A disadvantage of this toothbrush is that it relies on the local water system, which may not be safe, or available. Also, the use of the connecting hose restricts use of this toothbrush to the shower.

In another example, U.S. Pat. No. 5,893,378 to Llerena discloses a travel toothbrush that has a hollow handle for storing an antiseptic mouthwash. The mouthwash is accessible by removing a plug disposed within an aperture in the handle. A disadvantage of this toothbrush is that the fluid in the handle is only accessible through an aperture in the handle, and the fluid is not intended for tooth brushing purposes.

In still another example, U.S. Pat. No. 6,056,466 to Johnson et al. discloses a toothbrush with a refillable toothpaste chamber. The toothbrush includes a chamber holding toothpaste. The chamber is pressurized to activate the flow of toothpaste through the handle and out of the toothbrush. While this toothbrush works well in providing a supply of toothpaste, it does not solve the problem of the availability of water to rinse one's mouth out with when done brushing, which is an important step in the tooth brushing process.

The available of water, and in particular safe drinking water, is an important step in the tooth brushing process. Thus, there is need in the art for a toothbrush adapted to fit a bottle containing water from a known water supply, to assist in maintaining good oral hygiene.

SUMMARY OF THE INVENTION

Accordingly, the present invention is a safe water toothbrush assembly that includes a toothbrush connected to a bottle for brushing teeth. The toothbrush has an elongated body with a head at one end and an opening at another end, such that the interior of the body forms a passageway for transporting a fluid through the body, the head includes at least one aperture and the open end of the body is threaded. The toothbrush also includes a plurality of bristles extending radially from the head. The bottle is filled with a fluid, such as water, and an open end of the bottle includes threads complementary to the threads on the open end of the toothbrush, for securing the bottle to the toothbrush.

One advantage of the present invention is that a safe water toothbrush assembly is provided that promotes oral hygiene, even if a supply of drinking water is not available. Another advantage of the present invention is that the safe water toothbrush allows an individual to use a known water supply in brushing their teeth. Still another advantage of the present invention is that the safe toothbrush provides a supply of water for use in brushing an individual's teeth, when the individual doesn't have access to other supplies of water. Still another advantage of the present invention is that the safe water toothbrush is adaptable to fit onto commercially available water bottles. A further advantage of the present invention is that the safe water toothbrush provides for storage of toothpaste when not in use. Still a further advantage of the present invention is that the safe water toothbrush includes an end cap that also serves as a water-pic device. Yet a further advantage of the present invention is that the safe water toothbrush can be used in brushing the teeth of an animal, such as a dog.

Other features and advantages of the present invention will be readily appreciated, as the same becomes better understood after reading the subsequent description taken in conjun with the accompanying drawings.

BRIEF DESCRIPTION OF THE DRAWINGS

FIG. 5 is an exploded view of another embodiment of a one-piece safe water toothbrush assembly, according to the present invention; and FIG. 6 is an exploded view of the safe water toothbrush of FIG. 1, with the end cap of FIG. 4, according to the present invention.

DESCRIPTION OF THE PREFERRED EMBODIMENT(S)

Figure 1:
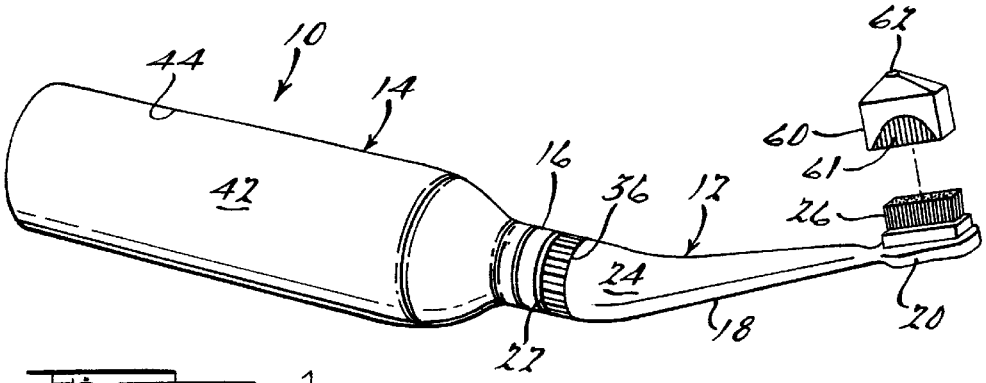
FIG. 1 is a perspective view of a safe water toothbrush assembly, according to the present invention.

Referring to FIG. 1, a safe water toothbrush assembly is illustrated. The safe water toothbrush assembly 10 includes a toothbrush 12 connected to a bottle 14 containing a fluid, such as water. Bottled water is known and conventional in the art. An open end of an outer wall of the bottle 14 is threaded with male threads 16. The dimensions of the threaded portion are generally universal in the art, so as to accept a corresponding cap, spout or the like having corresponding threads. Preferably, the bottle 14 is made from a plastic material, as is known in the art.

The safe water toothbrush 12 includes an elongated body 18 with a head 20 at one end and an opposite end 22 that is open for attaching the toothbrush 12 to the bottle 14. Advantageously, the shape of the body 18 is ergonomically designed to facilitate tooth brushing. For example, the body 18 is angled to facilitate the bristles 26 reaching a user's back teeth (not shown). An interior portion of the body 18 and head 20 form a passageway 24 for transporting a fluid, such as water. Preferably, the toothbrush head 20 and body 18 are integral and formed as one piece, such as molded using a plastic material.

The head 20 includes a plurality of radially extending bristles 26 arranged in a predetermined pattern, such as a predetermined number of rows and a predetermined number of columns. Preferably, the bristles 26 are made from a rigid material, such as nylon. The head 20 includes at least one aperture 28 that is continuous with the passageway 24 for dispensing the fluid transported therethrough the passageway 24. In this example, the aperture 28 is located between the bristles.

Figure 2:
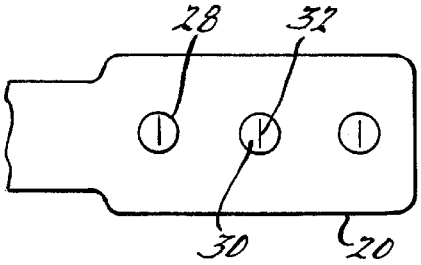
FIG. 2 is a top view of the head of the safe water toothbrush of FIG. 1, according to the present invention.

The safe water toothbrush 12 also includes a backflow preventative means 30 disposed in the aperture 28, such as a one-way valve. As illustrated in FIG. 2, one example of a one-way valve is a thin film of material with a slit 32. The pressure differential on either side of the film prevents the backflow of fluid through the slit 32 back into the passageway 24. Advantageously, this prevents the flow of potentially contaminated water back into the toothbrush 12 or bottle 14.

The open end 22 of the safe water toothbrush 12 includes an interior wall 36 that is threaded, for securing the safe water toothbrush 12 to the bottle 14. Preferably, the threads are female threads, as is known in the art, for engaging with the corresponding male threads of the bottle 14. The circumference of the open end 22 is determined by the corresponding bottle opening circumference.

In operation, the safe water toothbrush 12 is connected to the bottle 14 filled with water, such as by screwing the two together. The interior of the bottle 14 and passageway 24 in the toothbrush 12 form a continuous passageway 42. The user (not shown) squeezes the walls 44 of the bottle 14 to force a fluid such as water through the passageway 42 in the bottle 14 and body of the toothbrush 12 and out of the apertures 28 in the head 20 of the toothbrush 12. Alternatively, the user raises the bottle 14 to a sufficient height to initiate the flow of fluid therethrough the integral passageway 42 using the effects of gravity. Advantageously, the user can utilize the fluid to wet the bristles 26 of the toothbrush 12 or rinse their mouth while brushing their teeth.

Figure 3:
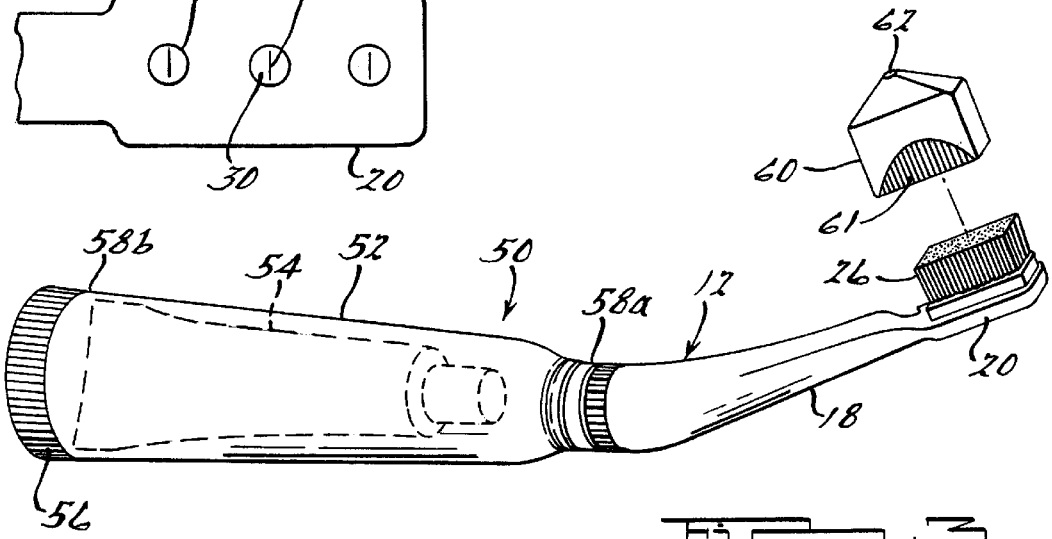
FIG. 3 is a perspective view of another embodiment of the safe water toothbrush of FIG. 1 with a storage provision, according to the present invention.

Referring to FIG. 3, an other embodiment of the safe water toothbrush assembly 50 is illustrated. Like features are referenced by like numerals. In this embodiment, the toothbrush assembly 50 includes a storage tube 52 for storing an oral cleanser 54, such as toothpaste. The storage tube 52 is disposed between the toothbrush 12 and bottle 14. One end 58*a* of the storage tube 52 is threaded with a male thread, to engage the corresponding female threads of the toothbrush 12. The other end 58*b* of the storage tube 52 is threaded with a female thread, to engage corresponding the male threads of the water bottle 14. It is contemplated that the toothbrush head 20, body 18 and storage tube 52 can also be integral and formed as one piece.

The toothbrush 12 also includes a threaded end cap 56 that fits over the end 58*b* of the storage tube 52, for retaining the toothpaste 54 therein. Preferably the threads are male threads, to engage the corresponding female threads of the other end 58*b* of the storage tank. It should be appreciated that the cap 56 can also be used on the toothbrush 12 of FIG. 1.

Figure 4:
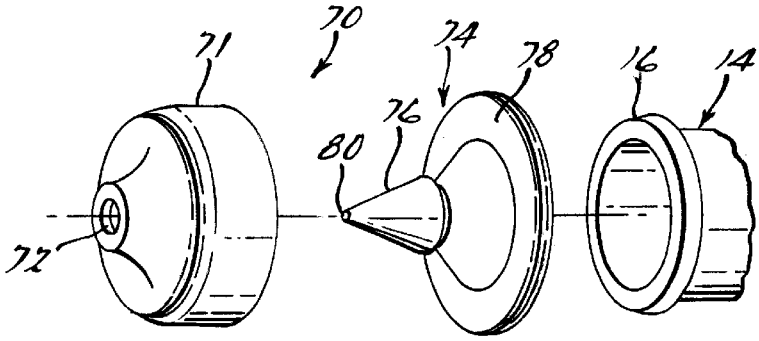
FIG. 4 is a perspective view of still another embodiment of an end cap for the safe water toothbrush of FIG. 3, according to the present invention.

Referring to FIGS. 4 and 6, still another embodiment of the safe water toothbrush assembly is illustrated. Like features are referenced by like numerals. In this example, the safe water toothbrush assembly functions as a water-pic. The safe water toothbrush assembly includes a water-pic end cap assembly 70. The end cap assembly 70 includes a threaded cap 71 with a centrally located aperture 72. Preferably, the threads are female threads, to engage the corresponding male threads of the bottle 14. A pic 74 is disposed within a recessed portion of the cap 71 and extends therethrough the cap aperture 72. An outwardly extending portion 76 of the pic 74 has a conical shape. A retaining portion 78 of the pic 74 has a broader conical shape than the outwardly extending portion 76, to retain the pic 74 in the recessed portion of the cap 71. The interior of the pic 74 forms a longitudinally extending passageway 80. The end cap assembly 70 is threaded onto the end 16 of the bottle 14. By squeezing the bottle 14, a concentrated jet flow of water is dispensed out through the passageway 80 in the tip, similar to a water-pic device, as is understood in the art. It should be appreciated that the pic 74 can also be used as a solid toothpick. It should also be appreciated that with a female threaded adaptor 82, as shown in FIG. 6, the water-pic end cap assembly 70 can be attached to the safe water toothbrush assembly 10.

Referring back to FIGS. 1 or 3, in yet still another embodiment, the safe water toothbrush assembly 10 includes a protective cover 60 that is secured over the head 20 of the toothbrush 12, such as by an interference fit between the cover 60 and the toothbrush head 20. The shape of the cover 60 corresponds to the combined shape of the head 20 and bristles 26 of the safe water toothbrush 12. It is contemplated that the cover 60 may include an aperture 62, to provide either drainage, air circulation, or a concentrated jet flow of water, in a manner similar to a water-pic device. Also, the cover 60 may include a plurality of longitudinally extending ribs 61, to provide a grip surface.

Referring to FIG. 5, in a further embodiment, the safe water toothbrush assembly 100 includes a toothbrush portion 112 and bottle portion 114 that are integral and formed as one piece. One end 116 of the bottle portion 114 is open, to fill the bottle. Advantageously, the bottle portion 114 provides for storage of a supply of water. The toothbrush 112 includes the features described with respect to the toothbrush 12. The safe water toothbrush assembly 100 is made of a flexible plastic material. The assembly 100 also includes the threaded end cap 56, previously described with respect to the two-piece assembly 10, that fits over the end 116 of the bottle portion 114. In addition, the water-pic end cap assembly 70, previously described, can be used with this assembly 100. In this example, a spacer 155 having a disc shape is placed between the end 116 of the bottle 114 and end cap assembly 70 to prevent leakage of fluid out of the end cap assembly 70.

The present invention has been described in an illustrative manner. It is to be understood that the terminology, which has been used, is intended to be in the nature of words of description rather than of limitation.

Many modifications and variations of the present invention are possible in light of the above teachings. Therefore, within the scope of the appended claims, the present invention may be practiced other than as specifically described.

What is claimed is:

1. A safe water toothbrush assembly for directing a concentrated stream of liquid into a mouth of a user comprising:

a toothbrush having an elongated body with a generally planar head at one end and open at an opposite end, wherein an interior of said body and said head forms a passageway for transporting the liquid through said body and said head, and the open end of said body is threaded;

a plurality of bristles extending radially from said head;

a backflow preventative means disposed within an aperture in said head adjacent a base of said bristles, to prevent the backflow of fluid back into said passageway; and a bottle containing the liquid removably attached to said toothbrush, wherein an open end of said bottle includes complementary threads to threads on the open end of said toothbrush for attaching said bottle to said toothbrush, an interior of said bottle forms a continuous passageway with the passageway in said body and said head, and a wall of said bottle is squeezable to forcibly transfer the liquid through the continuous passageway and out of said backflow preventative means and away from said bristles in a concentrated stream directed into a mouth of the user; and a threaded cap for enclosing the open end of said body, when said body is removed from the bottle, wherein said end cap includes an outwardly projecting tip.

2. A safe water toothbrush assembly as set forth in claim 1 wherein said body of said toothbrush is ergonomically angled with respect to said bottle for brushing teeth.

3. A safe water toothbrush assembly as set forth in claim 1 wherein said bristles are arranged in a predetermined pattern of rows and columns.

4. A safe water toothbrush assembly as set forth in claim 1 wherein the aperture is positioned between said bristles.

5. A safe water toothbrush assembly as set forth in claim 1 wherein said backflow preventative means is a one-way valve of a film with a slit in the film.

6. A safe water toothbrush assembly as set forth in claim 1 wherein an interior wall of the open end of said toothbrush includes female threads and an exterior wall of the open end of said bottle includes complementary male threads.

7. A safe water toothbrush assembly as set forth in claim 1 further comprising a storage tube removably attached to the open end of said body for storing an oral cleanser, when the open end of said body is not attached to said bottle.

8. A safe water toothbrush assembly as set forth in claim 1, wherein said body is elongated to include a storage portion for an oral cleanser when said toothbrush body is disconnected from said bottle.

9. A safe water toothbrush assembly as set forth in claim 1 further comprising a cap fitting over said bristles.

10. A safe water toothbrush assembly as set forth in claim 1 wherein said outwardly projecting tip includes an aperture in said tip.

11. The method as set forth in claim 1, further including the step of storing the oral cleanser in the passageway and covering the open end of the body with an end cap after rinsing the oral cleanser from the user's teeth.

12. A safe water toothbrush assembly for rinsing a user's mouth with water after brushing with an oral cleanser, said safe water toothbrush comprising:

an elongated body with a generally planar head at one end and open at an opposite end, such that said head is ergonomically angled with respect to said body for rinsing the teeth after brushing, wherein an interior of said body and said head forms a passageway for transporting the water therethrough, and the open end of said body is threaded;

a plurality of bristles arranged in a predetermined pattern and extending radially form said head;

a one-way valve disposed within an aperture in said head adjacent a base of said a bristles, to prevent the backflow of water back into said passageway;

a bottle containing the water removably attached to said body, wherein an open end of said bottle includes complementary threads to threads on the open end of said body for attaching said bottle to said body, an interior of said bottle forms a continuous passageway with said passageway in said body and said head, and a wall of said bottle is squeezable to forcibly transfer the water through the continuous passageway and out of the one-way valve in a concentrated stream directed into the mouth of the user; and a threaded end cap for enclosing the open end of said body when said body is removed from said bottle wherein said end cap includes an outwardly projecting tip.

13. A safe water toothbrush assembly as set forth in claim 12 wherein said body is elongated to include a storage portion for an oral cleanser when said toothbrush body is disconnected from said bottle.

14. A safe water toothbrush assembly as set forth in claim 12 wherein said outwardly projecting tip includes an aperture in said tip.

15. A method of brushing the teeth of a user with a safe water toothbrush assembly, said method comprising the steps of:

connecting the toothbrush to a bottle filled with water, wherein the toothbrush includes an elongated body with a generally planar head at one end and having a plurality of radially extending bristles from the head and open at an opposite end that is treaded, such that an interior of the body, head and bottle forms a continuous passageway for transporting the liquid therethrough;

applying an oral cleanser to the bristles;

brushing the teeth using the oral cleanser on the bristles of the toothbrush assembly;

squeezing the bottle to force the water through the continuous passageway;

dispensing the water through a backflow preventative means disposed within an aperture in the head adjacent a base of the bristles in a concentrated stream directed into a mouth of the user, and the backflow prevention means prevents the back flow of fluid back into the passageway; and rinsing the oral cleanser from the user's teeth using the water.

* * * * *

UNITED STATES PATENT AND TRADEMARK OFFICE

CERTIFICATE OF CORRECTION

PATENT NO. : 6,536,979 B1
DATED : March 25, 2003
INVENTOR(S) : Kenny et al.

It is certified that error appears in the above-identified patent and that said Letters Patent is hereby corrected as shown below:

Column 1,
Line 52, replace “available” with -- availability --.

Column 2,
Line 26, replace “conjun” with -- conjunction --.

Column 6,
Line 7, replace “form” with -- from --.
Line 9, after “said” delete “a”.

Signed and Sealed this

Thirtieth Day of September, 2003

JAMES E. ROGAN
*Director of the United States Patent and Trademark Office*